US010563460B2

(12) United States Patent
Odegbami et al.

(10) Patent No.: US 10,563,460 B2
(45) Date of Patent: Feb. 18, 2020

(54) ACTUATOR CONTROLLED VARIABLE FLOW AREA STATOR FOR FLOW SPLITTING IN DOWN-HOLE TOOLS

(71) Applicant: HALLIBURTON ENERGY SERVICES, INC., Houston, TX (US)

(72) Inventors: Olumide O. Odegbami, Houston, TX (US); Stephen Christopher Janes, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 168 days.

(21) Appl. No.: 15/555,445

(22) PCT Filed: Mar. 31, 2015

(86) PCT No.: PCT/US2015/023729
§ 371 (c)(1),
(2) Date: Sep. 1, 2017

(87) PCT Pub. No.: WO2016/160000
PCT Pub. Date: Oct. 6, 2016

(65) Prior Publication Data

US 2018/0038164 A1 Feb. 8, 2018

(51) Int. Cl.
*E21B 17/18* (2006.01)
*E21B 21/10* (2006.01)
(Continued)

(52) U.S. Cl.
CPC ..... *E21B 4/02* (2013.01); *E21B 17/18* (2013.01); *E21B 21/10* (2013.01); *E21B 34/08* (2013.01); *E21B 4/003* (2013.01); *E21B 34/10* (2013.01)

(58) Field of Classification Search
CPC . E21B 4/02; E21B 4/003; E21B 17/18; E21B 21/10; E21B 34/08; E21B 34/10
See application file for complete search history.

(56) References Cited

U.S. PATENT DOCUMENTS 2,705,590 A 4/1955 Lovesey et al.
3,949,354 A 4/1976 Claycomb
(Continued)

FOREIGN PATENT DOCUMENTS

EP 19728 B1 5/2014
RU 2265720 C1 12/2005
(Continued)

OTHER PUBLICATIONS

Russian Federation Intellectual Property Office, Search Report, dated Jul. 12, 2018 2 pages, Russia.
(Continued)

*Primary Examiner* — David J Bagnell
*Assistant Examiner* — Yanick A Akaragwe

(57) ABSTRACT

Systems and methods divide flow in a wellbore into a plurality of flow paths. A first one of the flow paths extends to a down-hole turbine that is responsive to fluid flow to provide rotational motion to an electric generator or other down-hole tool. A second flow path may extend to an independent down-hole tool, to a port communicating with the wellbore, to a bypass channel extending around the turbine, or to any other down-hole location. The turbine includes a stator having adjustable blades such that an open flow area through the turbine may be selectively controlled. A flow distribution between the first and second flow paths can be controlled where specific flow areas are needed at specific flow rates, for example.

20 Claims, 5 Drawing Sheets

(51) Int. Cl.

| | |
|---|---|
| ***E21B 34/08*** | (2006.01) |
| ***E21B 4/02*** | (2006.01) |
| *E21B 4/00* | (2006.01) |
| *E21B 34/10* | (2006.01) |

(56) References Cited

U.S. PATENT DOCUMENTS

| | | | | |
|---|---|---|---|---|
| 4,819,745 | A | 4/1989 | Walter | |
| 5,098,258 | A | 3/1992 | Barnetche-Gonzalez | |
| 5,517,464 | A | 5/1996 | Lerner et al. | |
| 5,626,200 | A | 5/1997 | Gilbert et al. | |
| 6,015,263 | A | 1/2000 | Morris | |
| 6,441,508 | B1 | 8/2002 | Hylton | |
| 6,763,899 | B1 | 7/2004 | Ossia et al. | |
| 6,984,105 | B2 | 1/2006 | Clark et al. | |
| 7,730,972 | B2 | 6/2010 | Hall et al. | |
| 8,297,375 | B2 | 10/2012 | Hall et al. | |
| 8,408,336 | B2 | 4/2013 | Hall et al. | |
| 8,469,104 | B2 * | 6/2013 | Downton | E21B 4/02 166/330 |
| 8,734,091 | B2 | 5/2014 | Moniz et al. | |
| 2009/0236148 | A1 | 9/2009 | Hall et al. | |
| 2009/0301784 | A1 | 12/2009 | Hall et al. | |
| 2015/0247953 | A1 * | 9/2015 | O'Brien | F03D 17/00 702/3 |

FOREIGN PATENT DOCUMENTS

| | | | |
|---|---|---|---|
| RU | 128656 | U1 | 5/2013 |
| WO | WO 2013/138212 | A1 | 9/2013 |

OTHER PUBLICATIONS

Korean Intellectual Property Office, International Search Report and Written Opinion, dated Nov. 17, 2015, 16 pages, Korea.

* cited by examiner

ACTUATOR CONTROLLED VARIABLE FLOW AREA STATOR FOR FLOW SPLITTING IN DOWN-HOLE TOOLS

CROSS-REFERENCE TO RELATED APPLICATIONS

This application is a U.S. national stage patent application of International Patent Application No. PCT/US2015/023729, filed on Mar. 31, 2015 the benefit of which is claimed and the disclosure of which is incorporated herein by reference in its entirety.

BACKGROUND

1. Field of the Invention

The present disclosure relates generally to dividing a fluid flow between two or more flow paths in a wellbore. More particularly, embodiments of the disclosure relate to systems and methods that employ an actuator to selectively restrict flow through a first flow path extending through a turbine, and thereby regulate the relative flow through at least one second flow path.

2. Background

Hydrocarbon drilling and production operations often require fluid flow systems to be installed in a subterranean wellbore. For example, drilling systems often circulate a drilling fluid (i.e., "mud") down-hole to provide lubrication to a drill bit and to carry geologic cuttings from the bottom of the wellbore. The mud is generally circulated down-hole into the wellbore through a drill string, out through the drill bit, and then back up to a surface location through an annulus defined between the drill string and a wall of the wellbore. Fluid flow systems are also installed for completion operations such as production and/or injection. Production systems generally receive hydrocarbons, water or other fluids from the subterranean formation through down-hole valves or other flow control devices, and then deliver the fluids to a surface location through a string of production tubing. Injection systems generally transport fluids from the surface to down-hole locations in the wellbore, and then introduce the fluids into the subterranean formation.

Often, a portion of the fluid in a down-hole fluid flow system is split from a main conduit and employed to achieve various down-hole objectives. For example, energy is often extracted from these fluids for electricity generation, heat transfer, mechanically opening or closing down-hole valves, or other types of actuation of down-hole tools. In many instances, to extract the energy, the portion of the fluid split from the main conduit is diverted through a down-hole turbine. The turbine may have a rotor arranged to turn in response to fluid flow therethrough. The rotational motion can be transferred to a down-hole tool such as a drill bit, an electrical generator, a hydraulic pump, a valve mechanism or other apparatus that can be actuated by the rotational motion. In many instances, a bypass valve can be included in the main conduit to divide the flow from the main conduit to distribute an appropriate portion of the flow between a first path extending through the turbine and at least one second path that bypasses the turbine. In some instances, the bypass valve can add unnecessary complexity to the flow system.

BRIEF DESCRIPTION OF THE DRAWINGS

The disclosure is described in detail hereinafter on the basis of embodiments represented in the accompanying figures, in which.

DETAILED DESCRIPTION

Figure 1A:
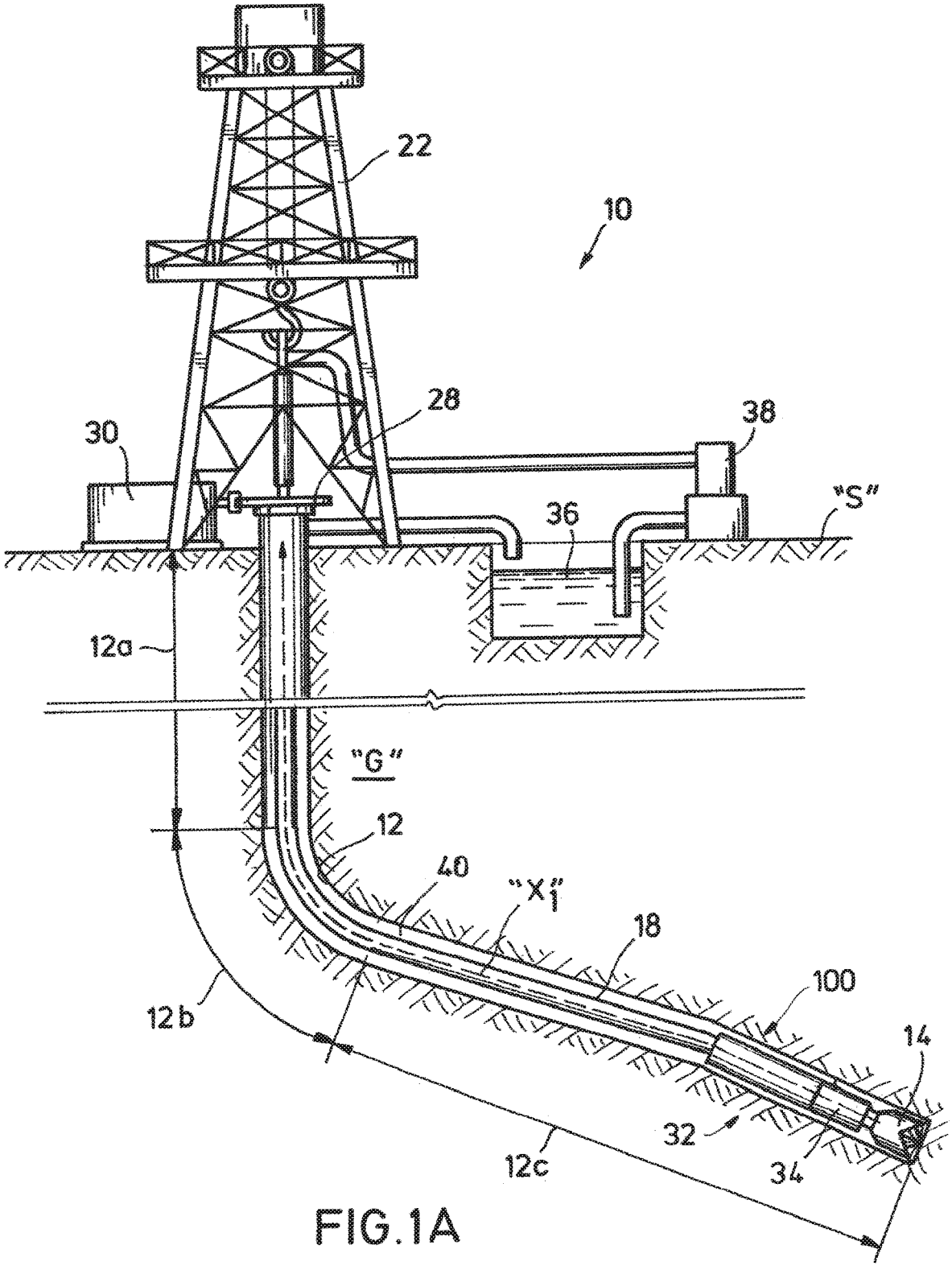
FIG. 1A is a schematic view of a drilling system that employs a flow splitting mechanism in accordance with one or more exemplary embodiments of the disclosure.

The disclosure may repeat reference numerals and/or letters in the various examples or Figures. This repetition is for the purpose of simplicity and clarity and does not in itself dictate a relationship between the various embodiments and/or configurations discussed. Further, spatially relative terms, such as beneath, below, lower, above, upper, up-hole, down-hole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure, the up-hole direction being toward the surface of the wellbore, the down-hole direction being toward the toe of the wellbore. Unless otherwise stated, the spatially relative terms are intended to encompass different orientations of the apparatus in use or operation in addition to the orientation depicted in the Figures. For example, if an apparatus in the Figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Moreover even though a Figure may depict a wellbore in a vertical wellbore, unless indicated otherwise, it should be understood by those skilled in the art that the apparatus according to the present disclosure is equally well suited for use in wellbores having other orientations including vertical wellbores, slanted wellbores, multilateral wellbores or the like. Likewise, unless otherwise noted, even though a Figure may depicts an offshore operation, it should be understood by those skilled in the art that the apparatus according to the present disclosure is equally well suited for use in onshore operations. Further, unless otherwise noted, even though a Figure may depict a cased hole, it should be understood by those skilled in the art that the apparatus according to the present disclosure is equally well suited for use in open-hole operations.

1. Description of Exemplary Embodiments

Referring to FIG. 1A, a directional drilling system 10 is one exemplary environment in which aspects of the present disclosure may be practiced. The directional drilling system 10 includes a down-hole flow splitting mechanism 100, according to one or more embodiments of the present disclosure. Although directional drilling system 10 is illustrated in the context of a terrestrial drilling operation, it will be appreciated by those skilled in the art that aspects of the disclosure may also be practiced in connection with offshore platforms and or other types of hydrocarbon exploration and recovery systems as well (see, e.g., FIG. 1B).

Directional drilling system 10 is partially disposed within a directional wellbore 12 traversing a geologic formation "G." The directional wellbore 12 extends from a surface location "S" along a curved longitudinal axis $X_1$. In some exemplary embodiments, the longitudinal axis $X_1$ includes a vertical section 12*a*, a build section 12*b* and a tangent section 12*c*. The tangent section 12*c* is the deepest section of the wellbore 12, and generally exhibits lower build rates (changes in the inclination of the wellbore 12) than the build section 12*b*. In some exemplary embodiments, the tangent section 12*c* is generally horizontal (see, e.g., FIG. 1B). Additionally, in one or more other exemplary embodiments, the wellbore 12 includes a wide variety of vertical, directional, deviated, slanted and/or horizontal portions therein, and may extend along any trajectory through the geologic formation "G."

A rotary drill bit 14 is provided at a down-hole location in the wellbore 12 (illustrated in the tangent section 12*c*) for cutting into the geologic formation "G." When rotated, the drill bit 14 operates to break up and generally disintegrate the geological formation "G." At the surface location "S" a drilling rig 22 is provided to facilitate rotation of the drill bit 14 and drilling of the wellbore 12. The drilling rig 22 includes a turntable 28 that generally rotates the drill string 18 and the drill bit 14 together about the longitudinal axis $X_1$. The turntable 28 is selectively driven by an engine 30, chain drive system or other or other apparatus. Rotation of the drill string 18 and the drill bit 14 together may generally be referred to as drilling in a "rotating mode," which maintains the directional heading of the rotary drill bit 14 and serves to produce a straight section of the wellbore 12, e.g., vertical section 12*a* and tangent section 12*c*.

In contrast, a "sliding mode" may be employed to change the direction of the rotary drill bit 14 and thereby produce a curved section of the wellbore 12, e.g., build section 12*b*. To operate in sliding mode, the turn table 28 may be locked such that the drill string 18 does not rotate about the longitudinal axis $X_1$, and the rotary drill bit 14 may be rotated with respect to the drill string 18. To facilitate rotation of the rotary drill bit 14 with respect to the drill string 18, a bottom hole assembly or BHA 32 is provided in the drill string 18 at a down-hole location in the wellbore 12. In the illustrated embodiment, the BHA 32 includes the down-hole flow splitting mechanism 100 and a down-hole mud motor 34 that rotates the drill bit 14 with respect to the drill string 18 in response to the flow of a drilling fluid such as drilling mud 36 therethrough.

To actuate the mud motor 34, to carry away cuttings from the drill bit 14, to provide support to the walls of the wellbore 12, and for other reasons appreciated by those skilled in the art, drilling mud 36 can be pumped down-hole. A mud pump 38 pumps drilling mud 36 through an interior of the drill string 18, where mud 36 passes through the flow splitting mechanism 100. A first portion of the mud 36 can be employed to drive the mud motor 34, and a second portion of the mud 36 can be routed directly to the drill bit 14 to flush away geologic cuttings, or to bearings (not explicitly shown) for lubrication, or to any other down-hole tools. The mud 36 is then returned through an annulus 40 defined between the drill string 18 and the geologic formation "G." The geologic cuttings and other debris are carried by the mud 36 to the surface location "S" where the cuttings and debris can be removed from the mud stream.

Figure 1B:
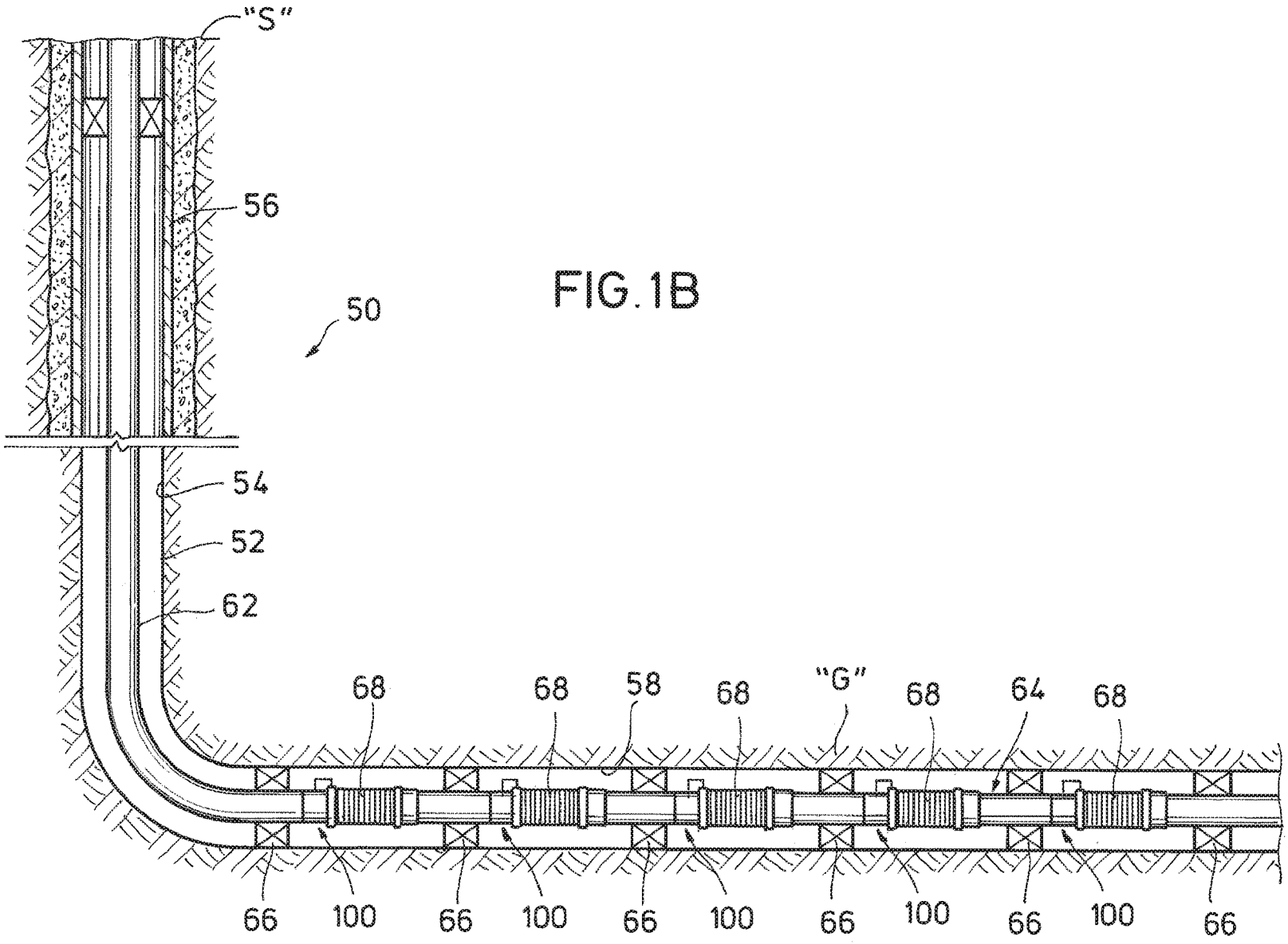
FIG. 1B is a schematic view of a well completion system including the flow splitting mechanism of FIG. 1A.

Referring to FIG. 1B, the flow splitting mechanism 100 may also be employed in other down-hole environments such as completion system 50. The completion system 50 is disposed in wellbore 52 that extend through the geologic formation "G." Wellbore 52 has a substantially vertical section 54, the upper portion of which has cemented therein a casing string 56. Wellbore 52 also has a substantially horizontal section 58 that extends through hydrocarbon bearing geologic formation "G". As illustrated, substantially horizontal section 58 of wellbore 52 is open hole, e.g., not including a casing string 56 therein.

Positioned within wellbore 52 and extending from the surface location "S" is a tubing string 62. Tubing string 62 provides a conduit for formation fluids to travel from the geologic formation "G" to the surface location "S" or for injection fluids to travel from the surface location "S" to the geologic formation "G." At its lower end, tubing string 62 is coupled to a completion string 64 that has been installed in wellbore 52. The completion string 64 is divided into a plurality of intervals by packers 66, which seal between the completion string 64 and the geologic formation "G". The completion string 64 includes a plurality of fluid flow control systems 68, which may include valves, screens or other mechanisms for controlling the flow of fluids into or out of the completion string 64.

In the illustrated embodiment, a flow splitting mechanism 100 is disposed adjacent each of the flow control systems 68. In other embodiments, other arrangements are contemplated such as arrangements where only a single flow splitting mechanism 100 is provided in the wellbore 52, or arrangements where multiple flow spitting mechanisms 100 adjacent each flow control system 68, depending on the operational objectives of completion system 50. In some exemplary embodiments, formation fluids enter completion string 64 through the flow control systems 68, and then flow through the flow splitting mechanisms 100 traveling up-hole toward tubing string 62. The flow splitting mechanism 100 can divert a portion of the formation fluids through a turbine (not explicitly illustrated in FIG. 1B) to provide power for operating the flow control system 68. In other embodiments, the flow splitting mechanism 100 can be operably coupled to the packers 66, or to other down-hole tools as will be appreciated by those skilled in the art.

Figure 2:
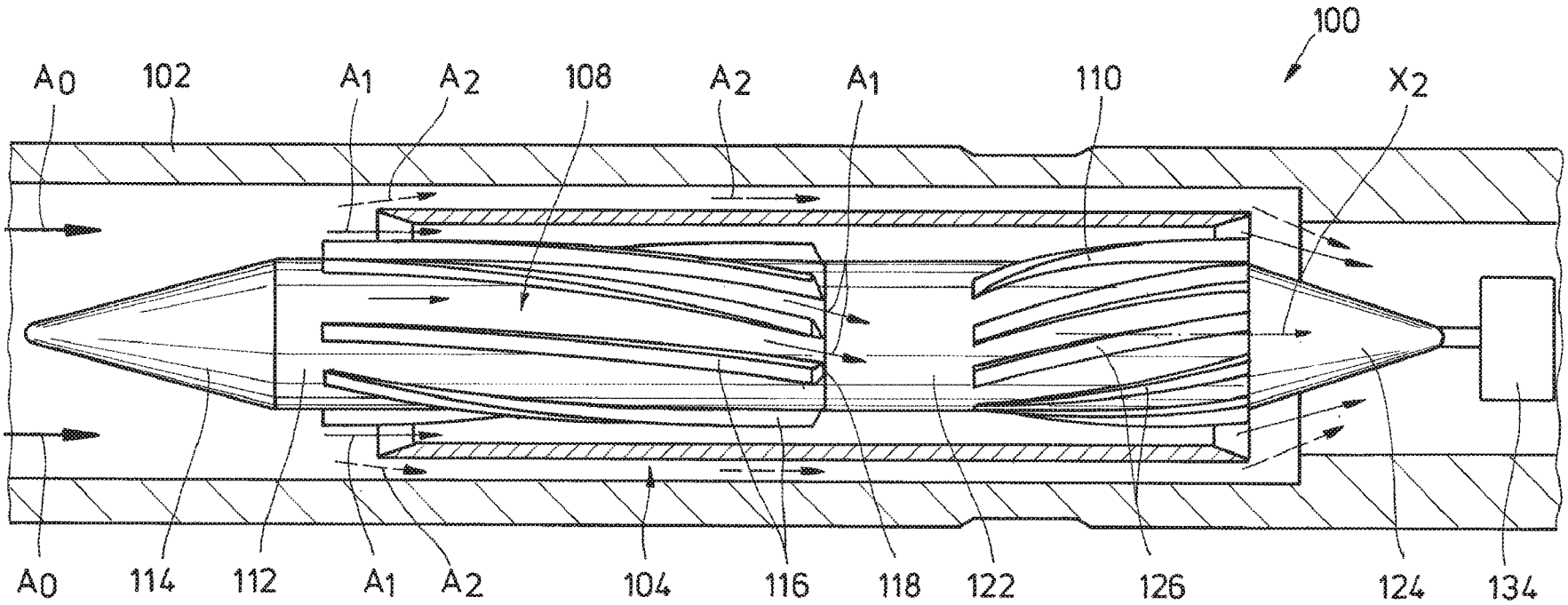
FIG. 2 is a cross-sectional view of the flow splitting mechanism of FIG. 1A illustrating a first flow path extending through a turbine and a second flow path bypassing the turbine.

Referring now to FIG. 2, a flow splitting mechanism 100 in accordance with aspects of the present disclosure is illustrated. The flow splitting mechanism 100 is arranged in a main conduit 102 for dividing a main flow in a main flow path (represented by arrow $A_0$) into distinct or separate flow paths. As described above, in some exemplary embodiments, the main conduit 102 may comprise a drill string 18 (FIG. 1A), a tubing string 62, a completion string 64 (FIG. 1B) or any other down-hole fluid conduit as will be appreciated by those skilled in the art. The flow splitting mechanism 100 divides fluid flow from the main flow path $A_0$ into a first flow in a first flow path (represented by arrows $A_1$) that extends through a turbine assembly 104 and a second flow path (represented by arrows $A_2$), which bypasses the turbine assembly 104. In some exemplary embodiments, the turbine assembly 104 can comprise any mechanism responsive to the circulation of a fluid therethrough to generate rotational motion. In some exemplary embodiments, the turbine assembly 104 can be a mud-motor mechanism, and in some exemplary embodiments, the turbine assembly 104 can be a positive-displacement motor, sometimes referred to as a Moineau-type motor.

The turbine assembly 104 includes a stator 108 and a rotor 110. In some exemplary embodiments, the stator 108 is mounted in a stationary manner with respect to the main conduit 102, and is arranged to remain stationary as fluid flows there past. The exemplary stator 108 includes a generally cylindrical body 112 with a conical leading end 114. A plurality of stator blades 116 protrude from the generally cylindrical body 112 and curve in a helical pattern toward a trailing end 118 of the stator 108. In some exemplary embodiments, the stator blades 116 are operable to maintain a generally stationary position with respect to the main conduit 102. For example, the stator blades 116 may maintain a non-rotating position (e.g., about a longitudinal axis $X_2$ of the turbine assembly 104) with respect to the main conduit 102 in response to fluid flow thereby.

In other embodiments, stator blades (not shown) may be provided in other configurations such as generally straight configurations, and/or configurations wherein stator blades (not shown) are provided that protrude inward from an interior wall of the main conduit 102. The stator blades 116 define flow channels there between and operate to direct the fluid flow through the first flow path ($A_1$) onto the rotor 110. The position and orientation of the stator blades 116 define an angle of attack for engaging the rotor 110 with the fluid. The rotor 110 includes a generally cylindrical body 122 with a conical trailing end 124. A plurality of rotor blades 126 protrude from the cylindrical body 122 of the rotor 110 and curve in a helical pattern toward the trailing end 124. The rotor blades 126 curve in an opposite direction than the stator blades 116 of the stator 108, and thus, fluid directed by stator blades 116 of the stator 108 engage the rotor blades 126 of the rotor 110 and transfer energy to the rotor blades 126 to cause the rotor 110 to rotate about the longitudinal axis $X_2$ of the turbine assembly 104.

A flow splitter 130 is positioned within the main conduit 102 and defines the first and second fluid flow paths ($A_1$ and $A_2$) extending from a main flow path $A_0$ in the main conduit 102. In some exemplary embodiments, the flow splitter 130 is passive and includes a tubular member arranged to at least partially circumscribe the stator 108 and rotor 110. A leading end 130*a* of the flow splitter 130 is tapered to direct a portion of the fluid flow into each of the fluid flow paths $A_1$, $A_2$, and thereby divide the fluid flow between the first and second flow paths $A_1$, $A_2$. The first flow path $A_1$ extends through an interior of the flow splitter 130 and through the turbine assembly 104. The second flow path $A_2$ extends through an annulus defined between an exterior of the flow splitter 130 and the main conduit 102 such that fluid flow through the second fluid flow path $A_2$ bypasses the stator 108 and rotor 110. The flow splitter 130 defines a boundary between the first and second fluid flow paths $A_1$, $A_2$, and thus the flow characteristics (flow resistance, pressure, volume, viscosity, etc.) maintainable within each of the fluid paths $A_1$, $A_2$ may be distinct and different from one another. In some exemplary embodiments, there is no fluid communication between the first and second fluid flow paths $A_1$, $A_2$ downstream of the leading end 130*a* of the flow splitter 130. In other exemplary embodiments, apertures (not shown) may be provided in the flow splitter 130, or conduits (not shown) may be provided that extend between the first and second fluid flow paths $A_1$, $A_2$ providing some degree of fluid communication between the first and second fluid flow paths $A_1$, $A_2$.

At the trailing end 124 of the rotor 110, the first and second flow paths $A_1$, $A_2$ recombine in the main conduit 102. In other exemplary embodiments, the second flow path $A_2$ may extend to a supplemental tool 132 (FIG. 3), directly to a drill bit 14 (FIG. 1A) for removing cuttings, or may extend to other down-hole locations. In some exemplary embodiments, the supplemental tool 132 may include a supplemental turbine assembly, hydraulically activated tools and/or the drill bit 14 (FIG. 1A).

The rotor 110 is operably coupled to a down-hole tool 134. In some exemplary embodiments, the down-hole tool 134 is directly coupled to the rotor 110 to receive torque or rotational motion from the rotor 110. In some exemplary embodiments the down-hole tool 134 may include an electric generator, a hydraulic pump, an, off-center vibratory tool cutting tool, a valve mechanism or tools recognized in the art. In some operational embodiments, the down-hole tool 134 may have speed requirements or optimal operating ranges that can be accommodated by a particular range of flow rates or other flow characteristics flowing through the first flow path $A_1$. Thus, the flow rate through the first flow path $A_1$ may be selectively adjusted within the particular range without compromising operational characteristics of the down-hole tool 134. By adjusting the flow characteristics through the first flow path $A_1$, the flow characteristics through the second flow path $A_2$ (and correspondingly a flow ratio between the first and second flow paths $A_1$ and $A_2$) may thereby be adjusted as well.

Figure 3:
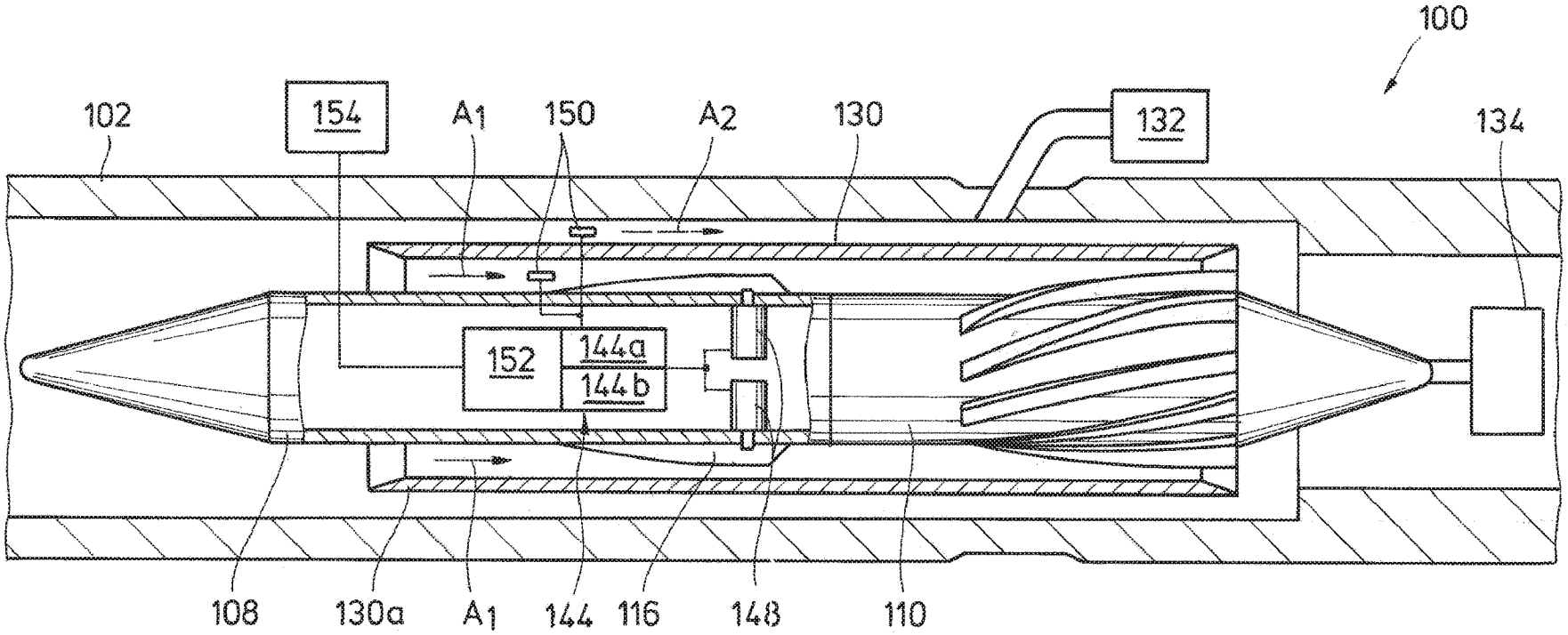
FIG. 3 is a schematic view of the flow splitting mechanism of FIG. 1A illustrating an actuator for controlling stator blades positioned upstream of a rotor of the turbine of FIG. 2.

Referring now to FIG. 3, the flow splitting mechanism 100 includes an adjustment mechanism 142. The adjustment mechanism 142 is operably coupled to one or more of the stator blades 116 of the stator 108 to adjust a pitch, orientation, or position of the stator blades 116 with respect to the generally cylindrical body 112 of the stator 108. The adjustment mechanism 142 is thus operable to control a flow area of the first flow path $A_1$, and also to thereby control a flow ratio between the first and second flow paths $A_1$ and $A_2$. The adjustment mechanism 142 is operable to selectively limit or restrict flow through the first flow path $A_1$, and in some exemplary embodiments, the adjustment mechanism 142 is operable to completely close the first flow path $A_1$. For example, the first flow path $A_1$ may be closed by engaging the stator blades 116 with the flow splitter 130, and/or with one another. By controlling the flow though the flow path $A_1$, the speed of the down-hole tool 134 can be controlled. Similarly, by controlling the flow through the first flow path $A_1$, the relative flow through the second flow path $A_2$ may also be controlled. In some exemplary embodiments, the second flow path $A_2$ is fluidly coupled to the supplemental tool 132, and thus, by controlling the relative flow through the second flow path $A_2$, the relative flow to the supplemental tool 132 may also be controlled.

The adjustment mechanism 142 includes a controller 144, which is operably and communicatively coupled to one or more actuators 148. As illustrated, each individual actuator 148 is coupled to an individual stator blade 116, and thus, each stator individual blade 116 can be adjusted independently of any of the other stator blades 116. In other exemplary embodiments (not shown), a single actuator 148 may be arranged to adjust a plurality of the stator blades 116 simultaneously or sequentially. In still other embodiments, one or more of the stator blades 116 may be mounted in a fixed or stationary manner with respect to the generally cylindrical body 112 of the stator 108, while one or more of the other stator blades 116 are operably coupled to an actuator 148 for selectively moving with respect to cylindrical body 112. In exemplary embodiments, the adjustment mechanism 142 may be operable to adjust the position of any subset of the stator blades 116. In some exemplary embodiments, the actuators 148 can include pneumatic or hydraulic pistons, a bevel gear assembly, a rack and pinion or a guide plate. In some exemplary embodiments, the actuator may include a motor such as an electric rotary motor or a linear motor. In some exemplary embodiments, the motor may be directly coupled to a stator blade 116 with a shaft coupling or other mechanism recognized in the art. In any event, controller 144 is operatively and communicatively coupled to the actuators 148 such that the controller 144 can selectively instruct the actuators 148, and receive feedback therefrom. In some exemplary embodiments, the actuator 148 may be operable to provide positional information to the controller 144 such that an intended adjustment may be verified.

In some embodiments, the controller 144 may include a computer having a processor 144*a* and a computer readable medium 144*b* operably coupled thereto. The computer readable medium 144*b* can include a nonvolatile or non-transitory memory with data and instructions that are accessible to the processor 144*a* and executable thereby. In one or more embodiments, the computer readable medium 144*b* is preprogrammed with predetermined sequences of instructions for operating the actuators 148 to achieve various objectives as described in greater detail below. In one or more embodiments, instructions may be communicated to the controller 144 in real time from the surface location "S" or from other down-hole locations.

In one or more embodiments, adjustment mechanism 142 optionally includes one or more feedback devices 150. The controller 144 is communicatively coupled to feedback devices 150, which are operable to detect and/or react to an environmental characteristic, and to provide a feedback signal representative of the environmental characteristic to the controller 144. In one or more embodiments, one or more of the feedback devices 150 are flow rate feedback devices operable to detect and/or react to an environmental characteristic from which a flow rate is determinable or estimable. As used herein, the term "representative" means at least that one signal, pressure or quantity is directly correlated, associated by mathematical function, and/or otherwise determinable or estimable from another signal pressure or quantity. In one or more embodiments, one or more feedback devices 150 may be positioned to measure a flow rate within the first flow path $A_1$, and one or more feedback devices 150 may be positioned to measure a flow rate in the second flow path $A_2$. Among other operations, the feedback devices 150 to provide information to the controller 144 from which the controller 144 may determine a position of the stator blades 116.

In some exemplary embodiments, the feedback devices 150 may include temperature sensors operable to detect a temperature of the fluid flowing through the first and second flow paths $A_1$, $A_2$ and/or a temperature of down-hole components in thermal communication with the fluid flowing through the first and second flow paths $A_1$ and $A_2$. For example, the feedback devices 150 may operate to detect a temperature of a housing (not explicitly depicted) of the turbine assembly 104, the flow splitter 130 and/or the main conduit 102. In some exemplary embodiments, the controller 144 may be pre-programmed with a threshold temperature above or below which more or less fluid can be directed through the flow paths $A_1$ and $A_2$. In this manner, more fluid may be directed through the particular flow path $A_1$ or $A_2$ in thermal contact with components that may require additional cooling.

A communication unit 152 may be provided in operative communication with the controller 144. In some embodiments, the communication unit 152 can serve as both a transmitter and receiver for communicating signals between the controller 144 and a surface unit 154, or for communicating signals between the controller 144 and another down-hole component. For example, the communication unit 152 can transmit data signals from feedback devices 150 to the surface unit 154 for evaluation by an operator. The communication unit 152 can also serve as a receiver for receiving data or instructions from the surface unit 154. In some exemplary embodiments, the surface unit 154 and the communication unit 152 are communicatively coupled to one another any type of telemetry system or any combination of telemetry systems, such as electromagnetic, acoustic and\or wired pipe telemetry systems for two-way communication between the surface unit 154 and the communication unit 152. The communication unit 152 may transmit data collected from the feedback devices 150 or information from the controller 144 in an up-hole direction to the surface unit 154 to be interpreted thereby, and the surface unit 154 may transmit instructions for the controller 144 in a down-hole direction to the communication unit 152.

2. Example Implementation

Figure 4:
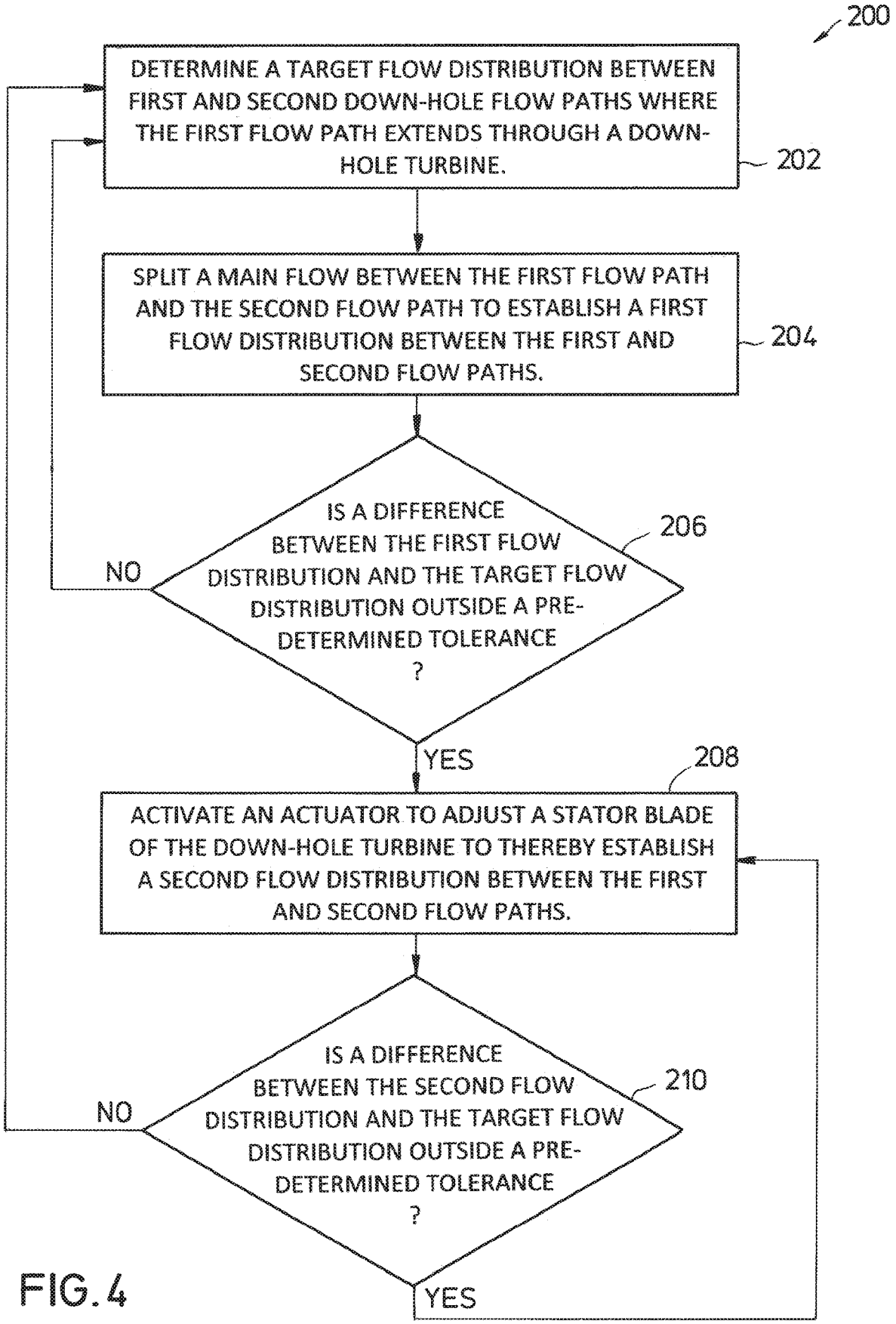
FIG. 4 is a flowchart illustrating an operational procedure employing the flow splitting mechanism of FIG. 1A in accordance with example embodiments of the disclosure.

Referring now to FIG. 4, and with reference to FIGS. 1A through 3, some exemplary embodiments of operational procedures 200 that employ the flow splitting mechanism 100 are described. In some exemplary embodiments, the operational procedures 200 serve to control an erosion rate within the turbine assembly 104 or on an exterior of the turbine assembly, e.g., by selectively reducing a proportion of a main flow $A_0$ flowing through or around the turbine assembly 104, respectively. In other exemplary embodiments, the operational procedure 200 serves to divert a portion of the main flow $A_0$ for cooling portions of the turbine assembly 104 or other down-hole components, for actuating a supplemental tool 132, to operate an additional turbine assembly, or to achieve other flow splitting objectives recognized in the art.

Initially at step 202, a target flow distribution between first and second down-hole flow paths $A_1$ and $A_2$ is determined. The target flow distribution can be determined based on functions to be performed by the flow through the first and second flow paths $A_1$ and $A_2$. For instance, when the flow splitting mechanism 100 is deployed in a drilling system 10 (FIG. 1A), the target flow distribution may be based on a required flow through the first flow path $A_1$ extending through the turbine assembly 104 to drive the drill bit 14, and also a required flow through the second flow path $A_2$ to sufficiently flush cuttings from the drill bit 14. In some exemplary embodiments, a tolerance with respect to the target flow distribution may be determined and preprogrammed onto the controller prior to deploying the adjustment mechanism 142 into the wellbore 12.

At step 204, the main flow $A_0$ is split between the first flow path $A_1$ and the second flow path $A_2$ to establish a first flow distribution there between. The flow distribution between the first and second flow paths $A_1$ and $A_2$ is established, at least in part, due to a resistance to flow through tubular member of the flow splitter 130. For instance, the available flow area through the flow splitter 130 and the angle of attack established by the blades of the stator 108 affect the flow resistance through the flow splitter 130, and thus affect the flow through the first and second flow paths first flow path $A_1$ and $A_2$.

Next, at decision 206, a determination is made whether a difference between the first flow distribution and the target flow distribution is outside a predetermined tolerance. This determination may be made based on information provided by the feedback devices 150, or by other methods recognized in the art. For example, where target flow distribution is defined to provide sufficient flushing of cuttings from a drill bit 14, for example, and where a slower drilling rate than expected is realized, a determination may be made that cuttings are not being effectively flushed form the drill bit 14 due to an insufficient flow through the second flow path $A_2$. Accordingly, a determination can be made that the difference between the first flow distribution and the target flow distribution is outside the predetermined tolerance. In some exemplary embodiments, the determination is made by an operator at the surface location "S" and in some embodiments; the determination is made by the controller 144.

In some exemplary embodiments, determining that a difference between the first flow distribution and the target flow distribution is outside a predetermined tolerance comprises determining that a temperature of a component in thermal communication with one of the first and second flow paths $A_1$ and $A_2$ is greater than a predetermined threshold temperature. The predetermined threshold temperature may be pre-programmed onto the controller 144, and data from the feedback devices 150 may assist in determining if the temperature of particular down-hole component may be outside a tolerance. The down-hole component may be heated or cooled by greater or lesser fluid flow thereby or therethrough.

Where the tolerance is exceeded, the procedure continues to step 208 where an adjustment to the stator blades 116 may be initiated as described below. Where the tolerance is not exceeded, e.g., where it is determined at decision 208 that a difference between the first flow distribution and the target flow distribution is not outside of the predetermined tolerance, operations may continue with no immediate adjustments to stator blades 116, and the procedure 200 returns to step 202 where a new target flow distribution may be determined.

At step 208, one or more of the actuators 148 are activated. In some exemplary embodiments, an operator at the surface location "S" transmits a signal from the surface unit 154 down hole to the communication unit 152, which receives the signal and converts the signal to a form readable by the controller 144. The controller 144 in turn, reads and interprets the signal, and then instructs the one or more actuators 148 based on the signal to move one or more of the stator blades 116 with respect to the cylindrical body 112 of stator 108. The movement of the stator blades 116 adjusts the resistance to flow through the turbine assembly 104 by adjusting a flow area through the flow splitter 130, or by adjusting a pitch of one or more of the stator blades 116 to obstruct or facilitate flow of the through the second flow path $A_1$. By adjusting the resistance of flow through the first flow path $A_1$, a second flow distribution between the first and second paths $A_1$ and $A_2$ is established.

Next, at decision 210, a determination is made whether a difference between the second flow distribution and the target flow distribution is within the predetermined tolerance. This determination may again be made based on information provided by the feedback devices 150, or by other methods recognized in the art. For example, if the drilling rate increases with the second flow distribution, a determination can be made that the second flow distribution is appropriate to continue operations. The procedure 200 may then again return to step 202 where a new target flow distribution can be determined. Where the second flow distribution is not appropriate, e.g., where the difference between the second flow distribution and the target flow distribution is outside the predetermined tolerance, the procedure 200 returns to step 208 where further adjustments to the stator blades may be made.

3. Aspects of the Disclosure

In one aspect, the disclosure is directed to a system for dividing flow in a wellbore. The system includes a main conduit defining a main flow path therethrough, and a flow splitter in positioned in fluid communication with the main conduit downstream of the main flow path. The flow splitter defines first and second distinct fluid flow paths extending from the main flow path. The system also includes a turbine assembly in fluid communication with the first flow path downstream of the flow splitter. The turbine assembly includes a stator disposed within the first flow path and having a plurality of stator blades operable to maintain a generally stationary position with respect to the main conduit during fluid flow through the first flow path. The turbine also includes a rotor responsive to the fluid flow through the first flow path to rotate with respect to the stator, and an actuator coupled to at least one of the stator blades. The actuator is operable to move the at least one stator blade to adjust a flow resistance through the first flow path.

In one or more exemplary embodiments, the stator comprises an elongate body disposed within the first flow path, and the plurality of stator blades protrudes radially outward from the elongate body to define flow channels there between. In some embodiments, the elongate body includes a generally cylindrical body, and the plurality of stator blades protrudes radially from the generally cylindrical body to define flow channels there between. In some embodiments, the stator blades curve in a helical manner toward a trailing end of the stator. In some exemplary embodiments, the generally stationary position of the stator blades may include a non-rotating position about a longitudinal axis of the turbine assembly.

In exemplary embodiments, the flow splitter includes a leading edge of a tubular member disposed within the main conduit, and wherein the stator is at least partially disposed within an interior of the tubular member. The second fluid flow path may extend through an annulus defined between an exterior of the tubular member and the main conduit such that fluid flow through the second fluid flow path bypasses the stator and rotor. In one or more exemplary embodiments, the system further includes a supplemental tool in fluid communication with the second fluid flow path, and the supplemental tool comprises at least one of a turbine assembly, a hydraulically activated tool and a drill bit.

In one or more exemplary embodiments, the actuator comprises at least one of the group consisting of a bevel gear assembly, a rack and pinion and a guide plate. In some exemplary embodiments, one or more of the stator blades is mounted in a fixed manner with respect to a body of the stator. In some exemplary embodiments, at least one stator blade is independently adjustable from another stator blade.

In another aspect, the present disclosure is directed to a method of dividing flow in a wellbore. The method includes (a) deploying a main conduit into a wellbore, (b) splitting a main flow of fluid in the main conduit between a first flow path and a second flow path, (c) flowing fluid through the first flow path to engage at least one stator blade and a rotor of a turbine assembly, (d) maintaining the at least one stator blade in a first stationary position with respect to the main conduit to establish a first flow distribution between the first and second flow paths, (e) moving the at least one stator blade to a second stationary position with respect to the main conduit to adjust a resistance to flow in the first flow path, and (f) maintaining the at least one stator blade in the second stationary position with respect to the main conduit to establish a second flow distribution between the first and second flow paths.

In one or more exemplary embodiments, moving the at least one stator blade to the second stationary position comprises activating an actuator operably coupled to the at least one stator blade. In some embodiments, activating the actuator comprises transmitting a signal to a controller operably coupled to the actuator and preprogrammed with a series of instructions for moving the at least one stator blade.

In some embodiments, the method further includes determining that a difference between the first flow distribution and a target flow distribution is outside a predetermined tolerance. In some exemplary embodiments, the predetermined tolerance is preprogrammed onto the controller prior to deploying the main conduit into the wellbore. In one or more exemplary embodiments, determining that a difference between the first flow distribution and the target flow distribution is outside a predetermined tolerance comprises determining that a temperature of a component in thermal communication with one of the first flow path and is greater than a predetermined threshold temperature.

In another aspect, the present disclosure is directed to a down-hole flow system including a main conduit extending through a subterranean formation and defining a main flow path therethrough. A flow splitter is positioned downstream of the main flow path and is operable to divide flow from the main flow path into first and second fluid flow paths extending from the main flow path. A rotor is disposed in the first flow path and is rotatable in the first flow path in response to a fluid flow through the first flow path. A stator is disposed in the first flow path. The stator includes a body and a plurality of stator blades extending from the body to guide the fluid flow into the rotor. The down-hole flow system also includes an adjustment mechanism operable to adjust a flow area defined by the first flow path. The adjustment mechanism includes an actuator and a controller. The actuator is operably coupled to at least one stator blade to move the at least one stator blade between first stationary position with respect to the body wherein a first flow area is defined through the first flow path, and a second stationary position with respect to the body wherein a second flow area is defined through the first flow path that is different than the first flow area. The controller is operably coupled to the actuator to selectively induce the actuator to move the at least one stator blade between the first and second positions.

In some exemplary embodiments, the main conduit includes at least one of the group consisting of a drill string, a production string and an injection string. In some exemplary embodiments, the down-hole flow system further includes a down-hole communication unit operably coupled to the controller. The down-hole communication unit may be operable to communicate with a surface unit disposed at a surface location outside the subterranean formation. In some exemplary embodiments, the controller is operable to determine a blade position, and in some exemplary embodiments, the communication unit is operable to transmit the blade position to the surface unit.

In one or more exemplary embodiments, the flow splitter includes a tubular member circumscribing at least a portion of the stator and the rotor such that the first flow path is defined on an interior of the tubular member and the second flow path is defined on the exterior of the tubular member. In some embodiments, the second flow area through the tubular member is fully closed when the at least one stator blade is in the second stationary position. In some exemplary embodiments, the adjustment mechanism is operable to move a subset of the plurality of stator blades.

Moreover, any of the methods described herein may be embodied within a system including electronic processing circuitry to implement any of the methods, or in a computer-program product including instructions which, when executed by at least one processor, causes the processor to perform any of the methods described herein.

The Abstract of the disclosure is solely for providing the United States Patent and Trademark Office and the public at large with a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed is:

1. A system for dividing flow in a wellbore, the system comprising:

a main conduit defining a main flow path therethrough;

a passive flow splitter positioned in fluid communication with the main conduit downstream of the main flow path, the flow splitter defining first and second fluid flow paths extending from the main flow path; and a turbine assembly in fluid communication with the first flow path downstream of the flow splitter, the turbine assembly comprising:

a stator within the first flow path, the stator including a plurality of stator blades operable to maintain a generally stationary position with respect to the main conduit during fluid flow through the first flow path;

a rotor responsive to the fluid flow through the first flow path to rotate with respect to the stator; and an actuator coupled to at least one of the stator blades, the actuator operable to move the at least one stator blade to adjust a flow resistance through the first flow path to thereby adjust a flow distribution between the first and second flow paths.

2. The system of claim 1, wherein the stator comprises an elongate body within the first flow path, and wherein the plurality of stator blades protrudes radially outward from the elongate body to define flow channels there between.

3. The system of claim 2, wherein the flow splitter comprises a tubular member circumscribing the stator and the first flow path, the tubular member including a circumferential leading edge defining a boundary between the first and second flow paths.

4. The system of claim 3, wherein the second fluid flow path extends through an annulus defined between an exterior of the tubular member and the conduit such that fluid flow through the second fluid flow path bypasses the stator and rotor and is recombined with flow through the first fluid path downstream of the turbine assembly.

5. The system of claim 1, wherein the actuator comprises at least one of the group consisting of a bevel gear assembly, a rack and pinion, a guide plate, and a direct coupling to a motor.

6. The system of claim 1, wherein one or more of the stator blades is mounted in a fixed manner with respect to a body of the stator.

7. The system of claim 1, wherein at least one stator blade is independently adjustable from another stator blade.

8. The system of claim 1, further comprising a supplemental tool in fluid communication with the second fluid flow path, and wherein the supplemental tool comprises at least one of a supplemental turbine assembly, a hydraulically activated tool and a drill bit.

9. A method of dividing flow in a wellbore, the method comprising:

deploying a main conduit into a wellbore;

passively splitting a main flow of fluid in the main conduit between a first flow path and a second flow path with a passive member disposed in the main conduit to define a boundary between the first and second flow paths;

flowing fluid through the first flow path to engage at least one stator blade and a rotor of a turbine assembly;

maintaining the at least one stator blade in a first stationary position with respect to the main conduit to establish a first flow distribution between the first and second flow paths;

moving the at least one stator blade to a second stationary position with respect to the main conduit to adjust a resistance to flow in the first flow path and thereby adjust the first flow distribution; and maintaining the at least one stator blade in the second stationary position with respect to the main conduit to establish a second flow distribution between the first and second flow paths.

10. The method of claim 9, wherein moving the at least one stator blade to the second stationary position comprises activating an actuator operably coupled to the at least one stator blade.

11. The method of claim 10, wherein activating the actuator comprises transmitting a signal to a controller operably coupled to the actuator and preprogrammed with a series of instructions for moving the at least one stator blade.

12. The method of claim 11, further comprising determining that a difference between the first flow distribution and a target flow distribution is outside a predetermined tolerance.

13. The method of claim 12, wherein determining that a difference between the first flow distribution and the target flow distribution is outside a predetermined tolerance comprises determining that a temperature of a component in thermal communication with one of the first flow path and is greater than a predetermined threshold temperature.

14. A down-hole flow system, comprising:

a main conduit extending through a subterranean formation and defining a main flow path therethrough;

a passive flow splitter positioned downstream of the main flow path and operable to divide flow from the main flow path into first and second fluid flow paths extending from the main flow path;

a rotor in the first flow path and rotatable in the first flow path in response to a fluid flow through the first flow path;

a stator in the first flow path, the stator including a body and a plurality of stator blades extending from the body to guide the fluid flow into the rotor; and an adjustment mechanism operable to adjust a flow area defined by the first flow path; the adjustment mechanism comprising:

an actuator operably coupled to at least one stator blade to move the at least one stator blade between first stationary position with respect to the body to thereby adjust a flow distribution between the first and second flow paths, and wherein a first flow area is defined through the first flow path, and a second stationary position with respect to the body wherein a second flow area is defined through the first flow path that is different than the first flow area; and a controller operably coupled to the actuator to selectively induce the actuator to move the at least one stator blade between the first and second positions.

15. The down-hole flow system of claim 14, wherein the main conduit includes at least one of the group consisting of a drill string, a production string and an injection string.

16. The down-hole flow system of claim 14, further comprising a down-hole communication unit operably coupled to the controller, wherein the down-hole communication unit is operable to communicate with a surface unit at a surface location outside the subterranean formation.

17. The down-hole flow system of claim 16, wherein the controller is operable to determine a stator blade position, and wherein the communication unit is operable to transmit the stator blade position to the surface unit.

18. The down-hole flow system of claim 14, wherein the flow splitter comprises a tubular member circumscribing at least a portion of the stator and the rotor such that the first flow path is defined on an interior of the tubular member and the second flow path is defined on the exterior of the tubular member.

19. The down-hole flow system of claim 18, wherein the second flow area through the tubular member is fully closed when the at least one stator blade is in the second stationary position.

20. The down-hole flow system of claim 14, wherein the adjustment mechanism is operable to move a subset of the plurality of stator blades.

* * * * *